US005440646A

United States Patent [19]

Settles et al.

[11] Patent Number: 5,440,646

[45] Date of Patent: Aug. 8, 1995

[54] MOLDED HOUSING WITH INTEGRAL ACOUSTIC CHAMBER AND ANTI-RATTLE PRINTED CIRCUIT BOARD SUPPORTS

[75] Inventors: Steven R. Settles, Sterling Heights; Eric J. Krupp, Canton; Frank Buccinna, Dearborn, all of Mich.

[73] Assignee: United Technologies Automotive, Inc., Dearborn, Mich.

[21] Appl. No.: 198,493

[22] Filed: Feb. 18, 1994

[51] Int. Cl.[6] ..... H04R 25/00

[52] U.S. Cl. ..... 381/188; 381/205; 381/90

[58] Field of Search ..... 381/188, 205, 90, 160, 381/87, 88; 206/320; 181/145, 148, 199

[56] References Cited

U.S. PATENT DOCUMENTS 4,313,521 2/1982 Rodden .
4,628,528 12/1986 Bose et al. ..... 381/90
4,658,298 4/1987 Takeda et al. ..... 206/320
4,837,837 6/1989 Taddeo .
5,067,159 11/1991 Kasai et al. .
5,097,513 3/1992 Jordan et al. ..... 381/160
5,147,986 9/1992 Cockrum et al. ..... 381/199

*Primary Examiner*—Curtis Kuntz
*Assistant Examiner*—Sinh Tran
*Attorney, Agent, or Firm*—Harness, Dickey & Pierce

[57] ABSTRACT

The present invention relates to a molded housing having an integral acoustic chamber and a plurality of post members which engage the printed circuit board contained therein to preclude rattling. As sound waves are generated within the acoustic chamber the sound waves travel along a directed path thereby enhancing the audible level of the sound waves allowed to escape the housing.

11 Claims, 2 Drawing Sheets

MOLDED HOUSING WITH INTEGRAL ACOUSTIC CHAMBER AND ANTI-RATTLE PRINTED CIRCUIT BOARD SUPPORTS

BACKGROUND OF THE INVENTION

I. Technical Field

This invention relates generally to housings for acoustical components and, more particularly, to a molded housing with an integral acoustic chamber and anti-rattle printed circuit board supports.

II. Discussion

Housing devices for use in containing electrical acoustic members such as transducers and sound generators have been used for a number of years. The objective of most housing devices is to enhance the decibel level of the sound wave output. One approach has been to modify the structure of the housing in an attempt to invert the negative portion of the sound wave into a positive to add to the decibel level. Thus, housings have been formed to include modified maze-like wall structures to purposefully redirect the sound waves generated within the housing. It is believed however that such maze-like structures are unnecessarily complicated and generally more difficult to produce.

Another approach has been to experiment with the materials from which the housings are made. In general, it is highly desirable that the material used to manufacture such housings be highly reflective of the sound waves generated therein to accentuate the bounce effect within the housing. In this regard, most housings have been manufactured incorporating metallic plates coated with various materials to reduce the absorption of sound waves into the housing structure. A major problem, however, with utilizing metal based structures is that such structures tend to add to the weight of the structure thus making it difficult to transport them in large quantities.

Still other approaches have included modifying the sound generator to produce the required decibel levels at the desired frequencies. This approach, perhaps more so than others, can be unduly costly in that specialty equipment not as readily available commercially is required.

SUMMARY OF THE INVENTION

In accordance with the teachings of the present invention, a molded housing with an integral acoustic chamber and anti-rattle printed circuit board supports is provided which solves one or more of the aforementioned problems associated with previously known acoustic housings. The printed circuit board utilized herein is generally double sided and includes a sound generator integrally attached to the inner surface. The printed circuit board is positioned within the housing such that the sound generator extends into the acoustic chamber which is located along one of the side walls of the housing. Further, the printed circuit board includes a plurality of apertures into which upwardly projecting support members formed along the housing extend to mechanically retain the printed circuit board within the housing. Once the printed circuit board has been properly positioned within the housing, a cover which is attached to the base portion of the housing via a living hinge is folded over and snapped closed to conceal the printed circuit board within the housing. Under a most preferred embodiment the inner surface of the cover includes a plurality of posts whereby upon closing the cover the posts exert pressure on the printed circuit board to maintain the printed circuit board tightly against the walls of the integral acoustic chamber. By varying the wall thickness of the acoustic chamber the performance of the acoustic chamber can be altered to meet specification requirements.

As the sound generator is activated thereby producing sound waves within the acoustic chamber, the waves travel from the first chamber section to the second chamber section then out of the chamber and into the cavity of the housing. Once into the cavity the sound waves are free to exit the housing through the opening provided along the bottom wall of the molded housing.

The primary advantage of the molded housing of the present invention is that the audio level is approximately doubled when the sound waves are input within the acoustic chamber and exit the passageway provided along the front of the housing.

Another advantage is that the sound waves can be produced with limited reverberation or rattle occurring within the housing during operation.

Still another advantage of the present invention is that the housing is readily actuated from a closed position to an open position, thus providing easy access to the printed circuit board contained therein.

Yet another advantage of the present invention is that the housing is relatively inexpensive to manufacture and easy to assemble.

Still another advantage of the present invention is that the molded housing can be quickly modified to adjust for different frequencies and audio levels.

In addition, another advantage is that the molded housing can be used to vary the frequency response curve of the sound generator being used.

Other advantages of the present invention will become readily appreciated by reference to the following description and claims, taken in conjunction with the accompanying drawings.

DETAILED DESCRIPTION OF THE PREFERRED EMBODIMENT

Figures 1, 4:
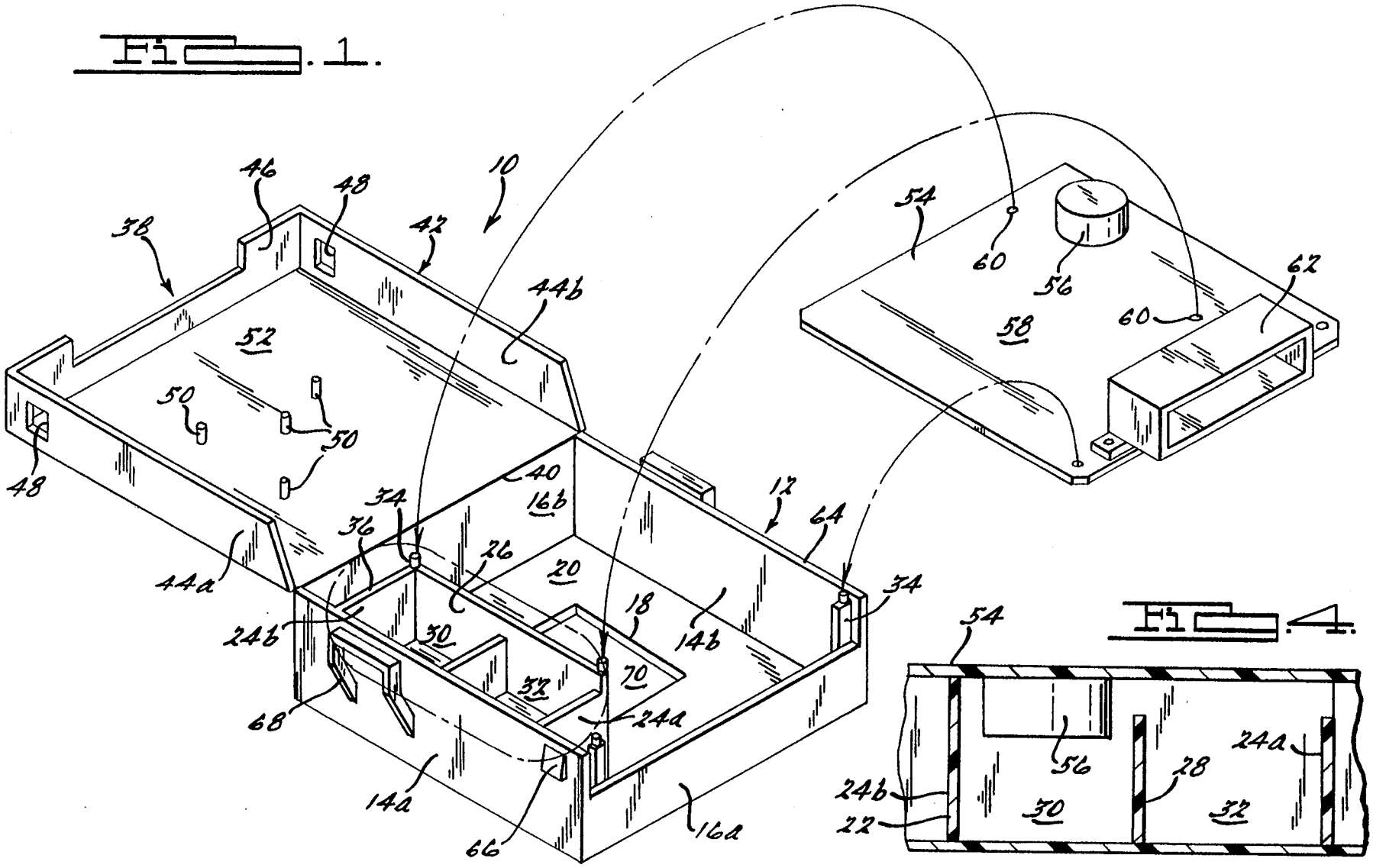
FIG. 1 is an exploded perspective view of the molded housing according to the teachings of the present invention.
FIG. 4 is a sectional view taken along line 4—4 of FIG. 3 illustrating the sound generator extending into the acoustic chamber.

Referring to FIG. 1 an exploded perspective view of the molded housing including an integral acoustic chamber is provided in accordance with the teachings of the present invention. The molded housing which will hereinafter be designated by reference numeral 10 includes a substantially rectangular base portion 12 having two spaced apart laterally extending sidewalls 14*a* and 14*b*, respectively, and two longitudinally extending end walls 16*a* and 16*b*, respectively. All four of the base portion walls extend from a transversely disposed bottom wall 18 to form a first cavity 20. Typically, the bottom wall 18 includes an opening 70 through which the sound waves are allowed to escape.

Figure 2:
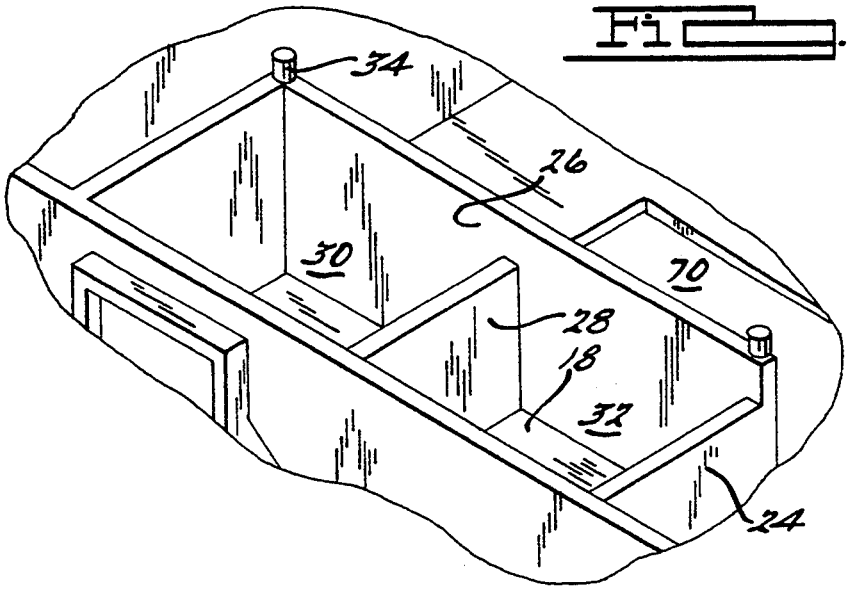
FIG. 2 is an enlarged perspective view of the acoustic chamber contained within the housing.

Provided within the base portion 12 along the first side wall 14*a* is an acoustic chamber 22 as shown more clearly with reference to FIGS. 2 and 4. The acoustic chamber 22 which also is substantially rectangular in geometry according to the preferred embodiment illustrated includes a pair of spaced apart walls 24*a* and 24*b* extending from both the bottom wall 18 and the inner surface of the side wall 14*a*. The acoustic chamber 22 also includes an elongated third wall 26 extending transversely between the walls 24*a* and 24*b* to define the acoustic chamber 22. Preferably, the second of the spaced apart walls, namely wall 24*a* is shorter in height than the first wall 24*b* to provide a means for the sound waves to escape the acoustic chamber as will be described in further detail below.

Additionally, the acoustic chamber 22 is provided with a partition wall 28 extending between the side wall 14*a* and the third wall 26. The partition wall is generally disposed parallel to the pair of spaced apart walls 24*a* and 24*b* to separate the acoustic chamber into first and second sections 30 and 32, respectively. Preferably, the partition wall 28 is slightly shorter in height than the end wall 24*b* to provide a means for the sound waves to travel from the first section 30 to the second section 32 of the acoustic chamber. In general, the height of the partition wall 28 is essentially a function of the angle of the sound waves being generated. By controlling the height of this partition wall 28 the number of sound waves allowed to escape the acoustic chamber is controlled to achieve the desired decibel level. For example, if too many out of phase sound waves are allowed to escape the chamber, the excessive sound waves will have a negative effect on the audible level. It should further be noted that while the partition wall 28 is generally disposed equidistantly between the pair of spaced apart walls 24*a* and 24*b*, the partition wall 28 can be located closer to either of the spaced apart walls 24*a* or 24*b* depending mainly on the position of the sound generator once attached.

Also, provided within the base portion 12 of the housing 10 are a plurality of support members 34 for hosting the printed circuit board shown at reference numeral 54. Generally, such support members 34 are positioned along each of the side walls 14*a* and 14*b* proximate to the front end wall 16a, and along the top edge 36 of the acoustic chamber 22.

In addition to the base portion 12 an integrally attached cover 38 is provided which extends from the top edge of the rear wall 16*b* via a living hinge 40. The cover 38 includes a skirt 42 consisting of two spaced apart longitudinally extending walls 44*a* and 44*b* and a laterally extending wall 46 which extends therebetween, whereby the skirt 42 is capable of at least partially, contiguously overlapping the side walls 14*a* and 14*b* and front end wall 16*a*. Disposed along each of the walls 44*a* and 44*b*, respectively, of the skirt 42 are tab receiving apertures 48*a* and 48*b* which assist in retaining the cover 38 in a closed position when desired. The cover 38 also includes a plurality of spaced apart, pressure generating post members 50 extending perpendicularly from the inner surface 52 thereof.

Lastly, with regard to the physical structure of the present invention a printed circuit board 54 is provided. The circuit board 54 which generally is a printed circuit board, includes electronic circuits (not shown) and a sound generator 56 which is integrally attached to the inner surface 58 of the circuit board. Preferably, the sound generator 56 will be capable of emitting sound waves over a relatively broad range such as between about 700 to about 1100 Hertz. Both the printed circuit board 54 and the integrally attached sound generator 56 are commercially available from a variety of sources such as for example Citizens Electronics and Star Micronics, among others. The printed circuit board 54 is also provided with a plurality of locating holes 60 which mate with the support members 34 provided within the base portion of the housing. A hollow rectangular connector 62 is provided on the printed circuit board 54 which is attachable to the vehicles wiring harness (not shown).

Figure 3:
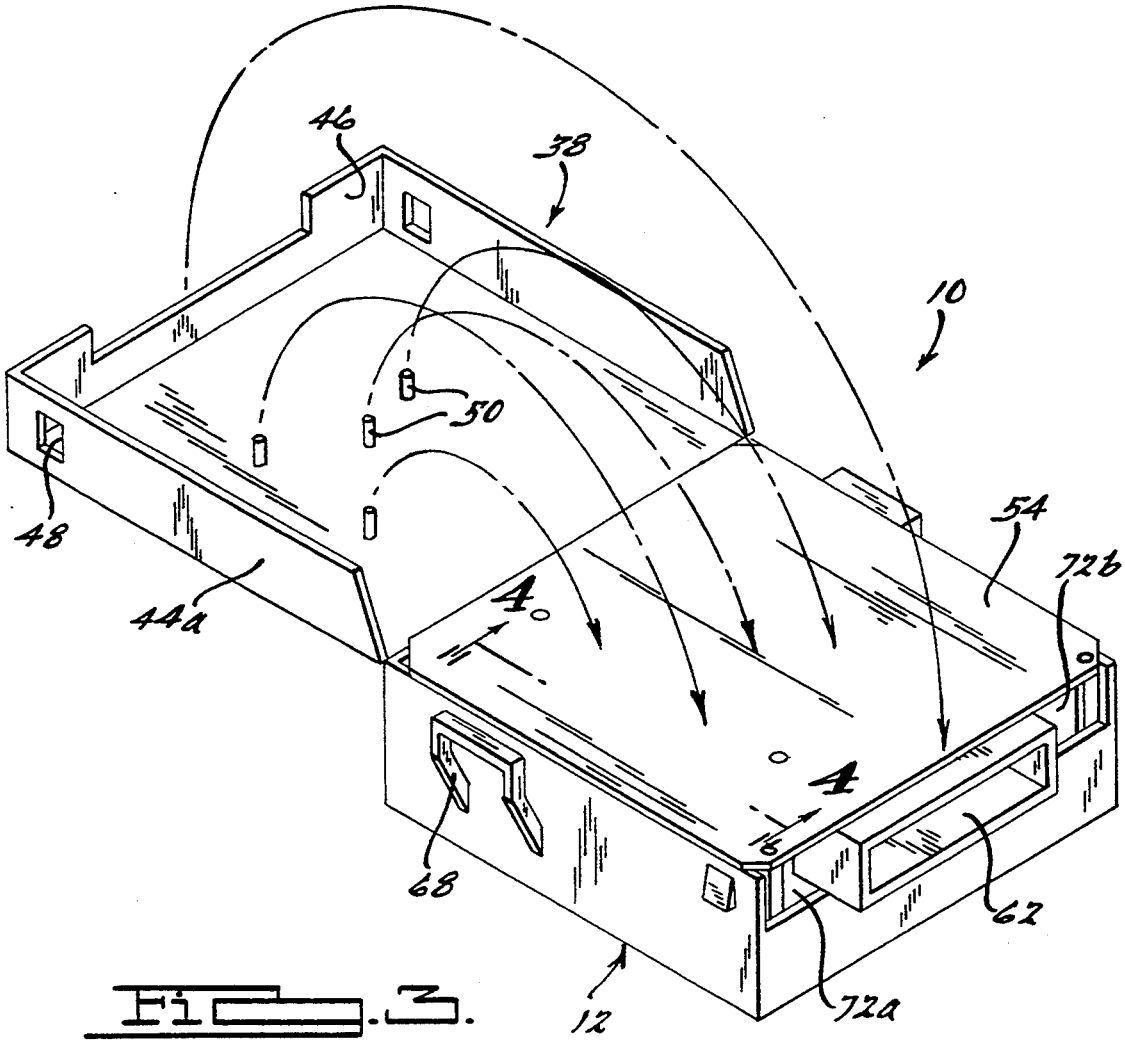
FIG. 3 is a perspective view illustrating the printed circuit board positioned within the housing prior to closing the housing cover.

Assembly and the operational aspects of the present invention will now be described in greater detail. With the cover 38 opened to provide access to the base portion 12 the printed circuit board 54 is inverted and positioned over the base portion 12 as illustrated in FIGS. 1 and 3. The circuit board is attached such that the support members 34 extending from the base portion are partially inserted through the locating holes 60 provided on the circuit board. Ideally, the circuit board comes to rest tightly against the top edge 36 of the acoustic chamber 22 with the sound generator 56 extending into the first section 30 of the acoustic chamber 22. Typically, the printed circuit board 54 also comes to rest along the peripheral top edge 64 of the base portion 12.

Once the printed circuit board 54 is attached to the base portion of the molded housing 10 as described, the cover 38 is actuated toward a closed position such that the skirt 42 partially overlaps the side walls 14*a* and 14*b* and the front wall 16*a*. As the cover 38 is advanced toward a closed position the post members 50 provided on the inner surface 52 of the cover press against the printed circuit board. This closure method serves two separate and distinct purposes. First, the pressure exerted on the printed circuit board 54 serves to more fully seal off the acoustic chamber 22 so that the sound waves generated therein can only escape via the intended path of travel. Secondly, in most housings for sound generators, as the sound generator is activated the printed circuit board tends to rattle due to the sound waves bouncing off the printed circuit. Thus, not only do the post members assist in sealing the acoustic chamber but also serve to limit rattling of the circuit board.

Upon full activation of the cover 38 toward the closed position the locking tabs 66 provided on the outer surface of the base portion 12 along the walls 14*a* and 14*b* protrude through the tab receiving apertures 48 provided along the cover's skirt, thereby locking the housing in a fully closed position. The housing 10 can now be transported by grasping the handles 68 provided along each side.

With regard to the theoretical path of travel of the sound waves generated within the housing 10, as the sound generator is activated the sound waves produced bounce around in the first acoustic chamber section 30, then pass over the partition wall 28 into the second chamber section 32. After bouncing around in this second section, the sound waves pass over the wall 24*a* and into the housing cavity 20. Eventually the sound waves exit the housing through the opening 70 provided in the bottom wall 18 and through the gaps 72*a* and 72*b* provided on either side of the connector 62.

While it will be apparent that the preferred embodiments of the invention disclosed are well calculated to provide the advantages stated above, it will be appreciated that the invention is susceptible to modification, variation and change without departing from the proper scope and fair meaning of the subjoined claims.

What is claimed is:

1. A housing for producing enhanced audible sound waves, comprising:

a base portion including a bottom having an opening and transversely disposed walls extending from said bottom to define a cavity, said cavity including an acoustic chamber having distinct sections defined by a first wall and a second spaced apart wall which is shorter than said first wall, a third wall extending between said first and second walls and a partition wall disposed parallel to said first and second walls, wherein said partition wall is shorter than said first wall;

means for generating sound waves, said means including a circuit board disposed over said base portion and a sound generator integrally attached to said circuit board, said sound generator extending into a first section of said acoustic chamber; and a cover attachable over said base portion and said circuit board;

wherein upon activating the sound generator sound waves are directed over a specific path of travel to enhance the audible level of sound waves allowed to escape from the housing.

2. The housing of claim 1, further comprising means for limiting rattling of said circuit board during periods of activation of the sound generator.

3. The housing of claim 2, wherein said means for limiting rattling of said circuit board include a plurality of support members which extend partially through apertures contained on the circuit board.

4. The housing of claim 2, wherein said means for limiting rattling of the circuit board include a plurality of post members extending from the inner surface of the cover, whereby upon full closure of the cover the post members press against the circuit board.

5. The housing of claim 1, wherein said cover is attachable over said base portion by a means for attaching, said means for attaching including at least one locking tab extending from said base portion and a tab receiving aperture disposed on said cover.

6. The housing of claim 5, wherein said cover is integrally attached to said base portion by a living hinge.

7. A housing for enhancing the audible level of sound waves, comprising:

a substantially rectangular base portion including:

(a) first and second lateral walls and first and second longitudinal walls, with all walls extending transversely from a bottom wall to define a cavity, said bottom wall including an opening for allowing sound waves to escape the cavity;

(b) an acoustic chamber disposed within said cavity including a first wall and a second shorter wall spaced apart from said first wall, a third wall extending between said first and second spaced apart walls, said third wall being substantially equal in height to said first wall, and at least one partition wall which is shorter in height than said first wall, said partition wall extending parallel to and between said first and second walls and transverse to said third wall to separate the acoustic chamber into sections;

means for generating sound waves, said means including a circuit board disposed over said base portion and a sound generator integrally attached to the circuit board, said sound generator extending into a first section of the acoustic chamber; and a substantially rectangular cover attached to said base portion via a living hinge, said cover including an extending skirt which partially overlaps said base portion upon closure of the cover;

wherein upon activating the sound generator, sound waves pass from a first acoustic chamber section to a second acoustic chamber section, out of said second acoustic chamber into the cavity and out the opening provided on the bottom wall of the base portion.

8. The housing of claim 7, further comprising means for limiting rattling of said circuit board during periods of activation of the sound generator.

9. The housing of claim 8, wherein said means for limiting rattling of said circuit board include a plurality of support members which extend partially through apertures contained on the circuit board.

10. The housing of claim 8, wherein said means for limiting rattling of the circuit board include a plurality of post members extending from the inner surface of the cover, whereby upon full closure of the cover the post members press against the circuit board.

11. The housing of claim 7, further comprising means for selectively locking said cover over said circuit board and said base portion, said means including at least one tab extending from said base portion and at least one tab receiving aperture disposed on said skirting, whereby said tab extends into the tab receiving aperture upon full closure of the cover.

* * * * *